US008927835B1

(12) United States Patent
Jones et al.

(10) Patent No.: US 8,927,835 B1
(45) Date of Patent: Jan. 6, 2015

(54) PIANO EXTENDED SOFT PEDAL

(71) Applicant: Steinway Musical Instruments, Inc., Waltham, MA (US)

(72) Inventors: Marvin Scott Jones, Bayside, NY (US); Susan Yake Kenagy, Dix Hills, NY (US); Sue Guan Lim, Jamaica, NY (US)

(73) Assignee: Steinway Musical Instruments, Inc., Waltham, MA (US)

( * ) Notice: Subject to any disclaimer, the term of this patent is extended or adjusted under 35 U.S.C. 154(b) by 0 days.

(21) Appl. No.: 14/045,088

(22) Filed: Oct. 3, 2013

(51) Int. Cl.
*G10C 3/00* (2006.01)
*G10C 3/16* (2006.01)
*G10C 3/26* (2006.01)

(52) U.S. Cl.
CPC . *G10C 3/161* (2013.01); *G10C 3/26* (2013.01)
USPC ..... 84/216

(58) Field of Classification Search
CPC ..... G10C 3/161; G10C 3/26
See application file for complete search history.

(56) References Cited

U.S. PATENT DOCUMENTS 519,611 A * 5/1894 Maurer ..... 84/242
788,203 A 4/1905 Glatt
803,752 A 11/1905 Glatt
808,190 A 12/1905 Bothner
812,705 A 2/1906 Vogel et al.
845,565 A 2/1907 Metzger
952,550 A 3/1910 Vough
963,837 A 7/1910 Vogel et al.
1,353,645 A 9/1920 George
1,368,107 A * 2/1921 Braunsdorf ..... 84/243
1,518,483 A * 12/1924 Conner ..... 84/243
5,287,787 A * 2/1994 Inoue ..... 84/240
8,541,671 B1 9/2013 Burgett et al.
2013/0205969 A1 * 8/2013 Fujii ..... 84/242

* cited by examiner

*Primary Examiner* — Robert W Horn
(74) *Attorney, Agent, or Firm* — Fish & Richardson P.C.

(57) ABSTRACT

A piano selectably playable in normal and soft mode includes multiple piano keys and multiple piano actions associated with the piano keys. Each piano action includes a piano hammer assembly and a piano wippen assembly actuated by depression of a corresponding piano key. Also included are multiple piano hammers, each mounted for rotating movement and defining a forward throw direction toward one or more corresponding piano string, and driven by a corresponding piano wippen assembly to transmit force applied to an associated piano key. One bridle strap, in a set of bridle straps, connects a piano hammer to a corresponding piano wippen assembly. A key lifting assembly in engagement with the piano keys and an associated bridle strap under tension cooperatively bring corresponding piano keys and piano wippen assemblies together in gap-closing movement.

45 Claims, 13 Drawing Sheets

PIANO EXTENDED SOFT PEDAL

TECHNICAL FIELD

This invention relates to upright or vertical pianos, and, in particular, to soft pedal assemblies of such pianos.

BACKGROUND

An acoustic piano employs various systems for transmitting energy from a finger or actuator input force into an auditory, vibrational force. The transmission system, commonly called the piano action, or action, is a network of levers, cushions and hammers that accepts finger/actuator input force through a collection of pivotal levers, known as piano keys, or keys. The piano keys and piano action focus this input force into rotating hammers of proportional density that are positioned to strike against tensioned wire strings. The piano hammers and their corresponding piano strings are both carefully constructed to match their acoustic properties, resulting in a tapered or graduated "scale" of components that cumulatively produce a multiple note span of musical frequencies. The piano strings act as media through which vibrational energy is transferred into an amplifier such as a soundboard, or electric speaker, where it ultimately is converted into audible sound.

Pianos can produce a wide range of volumes. Large pianos can further expand this range to include very loud sounds, such as heard in concert pianos that are expected to broadcast over an orchestra without the assistance of electric amplification. Pianos are present in many households, schools, institutions, etc. Inevitably, this proximity of sound-producing instruments creates situations where sound control and reduction are necessary. Many piano manufacturers offer pianos with sound level reducing mechanisms that selectively restrict volume level. In upright or vertical pianos, these mechanisms typically include a rail that shifts the position of the piano hammers relative to the strings, moving them closer together so that the hammers strike the strings with less kinetic energy. This type of soft pedal rail or hammer resting rail reduces the piano volume to a level of sound calculated to avoid disruption of neighboring environments such as apartments, practice rooms, etc.

SUMMARY

According to one aspect of the disclosure, a piano selectably playable in a normal mode and in a soft mode includes a set of multiple piano keys, a set of multiple piano actions associated with the multiple piano keys, each piano action comprising a piano hammer assembly and a piano wippen assembly actuated by depression of a corresponding piano key. Also included is a set of multiple piano hammers, each piano hammer mounted for rotating movement and defining a forward throw direction toward at least one corresponding piano string, each piano hammer being driven by a corresponding piano wippen assembly to transmit force applied to an associated piano key, as well as a set of multiple bridle straps, each bridle strap connecting a piano hammer to a corresponding piano wippen assembly. Also included is a key lifting assembly in engagement with the piano keys, wherein the key lifting assembly and an associated bridle strap under tension cooperatively bring corresponding piano keys and the piano wippen assemblies together in gap-closing movement.

In some implementations, the key lifting assembly and an associated bridle strap under tension may cooperatively lift the piano wippen assemblies and rear portions of the piano keys. The key lifting assembly and an associated bridle strap under tension can cooperatively lift rear portions of the piano keys. The key lifting assembly and an associated bridle strap under tension may cooperatively lift the piano wippen assemblies. The piano actions may include a set of multiple piano wippen assemblies, with each piano wippen assembly disposed for engagement with a portion of a corresponding piano hammer when the piano hammer is in a rest position, and the corresponding bridle strap tethering the piano hammer to the piano wippen assembly, wherein the key lifting assembly and associated bridle strap under tension cooperatively bring the piano wippen assembly and the piano hammer together in gap-closing movement during depression and subsequent release of the piano key. The key lifting assembly and the associated bridle strap under tension cooperatively bring the piano wippen assembly and the piano hammer together into gap-closing engagement during depression and subsequent release of the piano key.

In some implementations, the piano may include a soft pedal system, the soft pedal system comprising a soft pedal, a hammer resting rail mounted for movement between a normal mode position with the set of multiple piano hammers at a spaced distance from corresponding piano strings, and a soft mode position with the set of multiple piano hammers in positions relatively closer to the corresponding piano strings, and a soft pedal actuation device, wherein actuation of the soft pedal causes movement of the hammer resting rail from normal mode position to the soft mode position. The soft pedal actuation device may comprise a link connecting the hammer resting rail with the soft pedal. When the hammer resting rail is in soft mode position, forces exerted by the bridle strap under tension and the key lifting assembly may lift the piano wippen assembly and the piano keys. When the hammer resting rail is in soft mode position, forces exerted by the bridle strap under tension and the key lifting assembly may bring the piano wippen assembly relatively together in gap-closing motion with the corresponding piano hammer. When the hammer resting rail is in soft mode position, forces exerted by the key lifting assembly may act to maintain the piano wippen assembly in gap-closing relationship with the corresponding piano key.

In some embodiments, a key lifting assembly comprises a lift rail disposed for engagement with at least a subset of the set of multiple piano keys and can include at least one biasing element urging the lift rail toward engagement with the piano keys and a knob mounted for adjustment of lift rail position and lifting force. The piano keys may be additionally weighted, or not additionally weighted. The piano may include multiple key lifting assemblies, each of the multiple key lifting assemblies disposed for engagement with a subset of less than all of the multiple piano keys.

In further embodiments, a piano playable in a normal mode and in a soft mode includes a set of multiple piano keys, a set of multiple piano actions, each piano action actuated by depression of a corresponding piano key, a set of multiple rotatable piano hammers, each rotatable piano hammer defining a forward throw direction toward at least one corresponding piano string, and each rotatable piano hammer being driven by a corresponding piano wippen assembly transmitting force from a corresponding piano key; and a set of multiple bridle straps, each connecting a rotatable piano hammer with a corresponding piano wippen assembly, with the bridle strap remaining under gap-closing tension during the release of the corresponding piano key.

In some implementations, a piano playable in a normal mode and a soft mode, the piano includes a set of multiple piano keys, a set of multiple piano actions, each piano action actuated by depression of a corresponding piano key, a set of multiple rotatable piano hammers, each rotatable piano hammer defining a forward throw direction toward at least one corresponding piano string, and each rotatable piano hammer being driven by a corresponding piano wippen assembly to transmit force from a corresponding piano key, and a key lifting assembly disposed beneath the set of multiple piano keys, wherein the key lifting assembly exerts a force biasing the set of multiple piano keys in the direction of piano key pivot consistent with piano key depression.

In a further implementation, a piano playable in a normal mode and in a soft mode includes a set of multiple piano keys, a set of multiple piano actions, each piano action actuated by depression of a corresponding piano key, a set of multiple rotatable piano hammers, each rotatable piano hammer defining a forward throw direction toward at least one corresponding piano string, and each rotatable piano hammer being driven by a corresponding piano wippen assembly, transmitting force from a corresponding piano key, and a set of multiple bridle straps, each bridle strap connecting a rotatable piano hammer assembly with a corresponding piano wippen assembly, wherein the bridle strap remains under tension during the release of the corresponding piano key, where each bridle strap having a first end attached to a butt assembly of an associated piano hammer assembly and an opposite second end attached to an associated bridle wire, the bridle strap having an initial span between the first end of the bridle strap and the second end of the bridle strap when the piano key is in an unplayed position, and a final span between the first end of the bridle strap and the second end of the bridle strap when the piano key is in a played position, and the final span and the initial span of the bridle strap having a predetermined ratio under tension. In some cases, the predetermined ratio of the final span and the initial span is approximately 1.0 or is greater than 1.0.

In further implementations, a piano selectably playable in a normal mode and in a soft mode includes a set of multiple piano keys, a set of multiple piano actions associated with the multiple piano keys, each piano action including a piano hammer assembly and a piano wippen assembly actuated by depression of a corresponding piano key, a set of multiple piano hammers, each piano hammer mounted for rotating movement and defining a forward throw direction toward at least one corresponding piano string, each piano hammer being driven by a corresponding piano wippen assembly to transfer force applied to an associated piano key, a set of multiple bridle straps, each bridle strap connecting a piano hammer with a corresponding piano wippen assembly; and a soft pedal system. The soft pedal system includes a soft pedal, a hammer resting rail mounted for movement between a normal mode position with the set of multiple piano hammers at a spaced distance from corresponding piano strings, and a soft mode position with the set of multiple piano hammers in positions relatively closer to the corresponding piano strings and a soft pedal actuation device, wherein actuation of the soft pedal causes movement of the hammer resting rail from the normal mode position toward the soft mode position. The piano also includes a gap closing mechanism in engagement with the piano keys, wherein the gap closing mechanism lifts the piano keys and the piano wippen assemblies upon actuation of the soft pedal. The bridle straps can have a maximum span selected to bring the piano wippen assemblies and the piano hammers together in gap-closing movement. The bridle strap can have a first end fastened at a butt assembly of an associated piano hammer assembly and an opposite second end fastened at an associated bridle wire, and the bridle wire is configured to maintain the bridle strap at a maximum span during the force transfer applied to an associated piano wippen assembly. The gap closing mechanism can rotate the piano wippen assemblies in the forward direction relative to the piano strings and can include a distribution of mass in the piano wippen assemblies in a manner to urge rotation of the piano wippen assemblies toward the piano strings.

In further embodiments, a piano selectably playable in a normal mode and in a soft mode includes a set of multiple piano keys, a set of multiple piano actions associated with multiple piano keys, each piano action including a piano hammer assembly and a piano wippen assembly actuated by depression of a corresponding piano key, a set of multiple piano hammers, each piano hammer mounted for rotating movement and defining a forward throw direction toward at least one corresponding piano string, each piano hammer being driven by a corresponding piano wippen assembly to transmit force applied to an associated piano key, a set of multiple bridle straps, each bridle strap connecting a piano hammer with a corresponding piano wippen assembly, and a gap closing mechanism in engagement with the piano keys, wherein the gap closing mechanism lifts a rear portion of the piano keys to raise the piano wippen assemblies toward the piano hammers together in gap-closing movement. The gap closing mechanism can act on the piano keys by lowering a front portion of the piano keys.

In other embodiments, a piano selectably playable in a normal mode and in a soft mode includes a set of multiple piano keys, a set of multiple piano actions associated with the multiple piano keys, each piano action including a piano wippen assembly actuated by depression of a corresponding piano key, a set of multiple piano hammers, each piano hammer mounted for rotating movement and defining a forward throw direction toward at least one corresponding piano string, each piano hammer being driven by a corresponding piano wippen assembly to transfer force applied to an associated piano key, and a soft pedal system. The soft pedal system includes a soft pedal, a hammer resting rail mounted for movement between a normal mode position with the set of multiple piano hammers at a spaced distance from corresponding piano strings, and a soft mode position with the set of multiple piano hammers lifted into positions relatively closer to the corresponding piano strings, and a soft pedal actuation device, wherein actuation of the soft pedal causes movement of the hammer resting rail from the normal mode position toward the soft mode position and lifts the piano wippen assemblies along with the piano hammers in gap closing motion.

In other implementations, a set of multiple bridle strap and bridle wire combinations can also be included, each bridle strap and bridle wire combination connecting a piano hammer assembly to a corresponding piano wippen assembly, wherein actuation of the soft pedal actuation device tensions each bridle strap and bridle wire combination to lift a piano wippen assembly along with an associated piano hammer assembly in the gap closing motion.

In some implementations, tensioning of at least one of the bridle strap and bridle wire combinations is achieved by shortening at least one of the bridle strap and the bridle wire, or the other of the bridle strap and bridal wire is additionally shortened or additionally lengthened. Tensioning of at least one of the bridle strap and bridle wire combinations can be achieved by bending an upper end of the bridle wire below the bridle strap. Tensioning of at least one of the bridle strap and bridle wire combinations can be achieved by bending the upper end of the bridle wire relatively farther from the piano wippen assembly and closer to a piano player. Tensioning of at least one of the bridle strap and bridle wire combinations can be achieved by bending an upper end of the bridle wire below attachment of the bridle strap. Tensioning of at least one of the bridle strap and bridle wire combinations can be achieved by repositioning the bridle wire.

In some implementations, the hammer resting rail actuation device in soft play mode engages and lifts a rear undersurface region of the piano keys, and can engage and depress a front upper surface region of the piano keys. The hammer resting rail actuation device in soft play mode can engage the piano keys with linear or rotational motion, by spring, magnetic, or electromechanical force.

The disclosure thus provides improved upright or vertical pianos selectably playable in normal mode and in soft mode, with a tensioned bridle strap and bridle wire combination and/or with a soft pedal system that close the gaps inherently experienced with upright or vertical pianos, e.g. between the butt assembly and the jack of the piano action and/or between the wippen assembly and the capstan (or screw at the rear end of the piano key that contacts the wippen assembly), resulting in significant improvement in the situation of the unwanted touch sensation of "lost motion" experience during piano playing.

An object of this disclosure is to provide an upright or vertical piano in which the tensioned bridle strap 240 is mounted in a manner such that the span (i.e., effective length between attachments at opposite ends) of the tensioned bridle strap is approximately constant between initial position and final position, and also during transition between initial position and final position, thereby to reduce or eliminate gaps causing undesirable touch sensation of "lost motion" for the piano player. The effectiveness and extent of the improvement in 'lost motion" in different instruments, or even in the same instrument, can be expected to vary, e.g., as a result of the skill, experience and habits of the player, the playing conditions, the environment, the level maintenance of the piano and its parts, etc.

The details of one or more implementations of the disclosure are set forth in the accompanying drawings and the description below. Other features, objects, and advantages of the disclosure will be apparent from the description and drawings, and from the claims.

DESCRIPTION OF DRAWINGS

FIG. 4A is a side view of the conventional (prior art) piano action of FIG. 2 in a return from played position, while FIG. 4B is a similar, somewhat enlarged, side view of the conventional (prior art) piano action of FIG. 4A showing the gap (145) between the jack (154) and the butt (136).

FIG. 5A is a side view of the conventional (prior art) piano action of FIG. 2 with the soft pedal depressed, while FIG. 5B is a similar, somewhat enlarged, side view of the conventional (prior art) piano action of FIG. 5A, showing the gap (147) between the jack (154) and butt (136).

FIG. 7A is a side view of the soft piano action of FIG. 6 with the soft pedal depressed, while FIG. 7B is a similar, somewhat enlarged, side view of the piano action of FIG. 7A, showing the gap (249) between the wippen assembly (250) and the capstan (211).

Like reference symbols in the various drawings indicate like elements.

DETAILED DESCRIPTION

Figure 1:
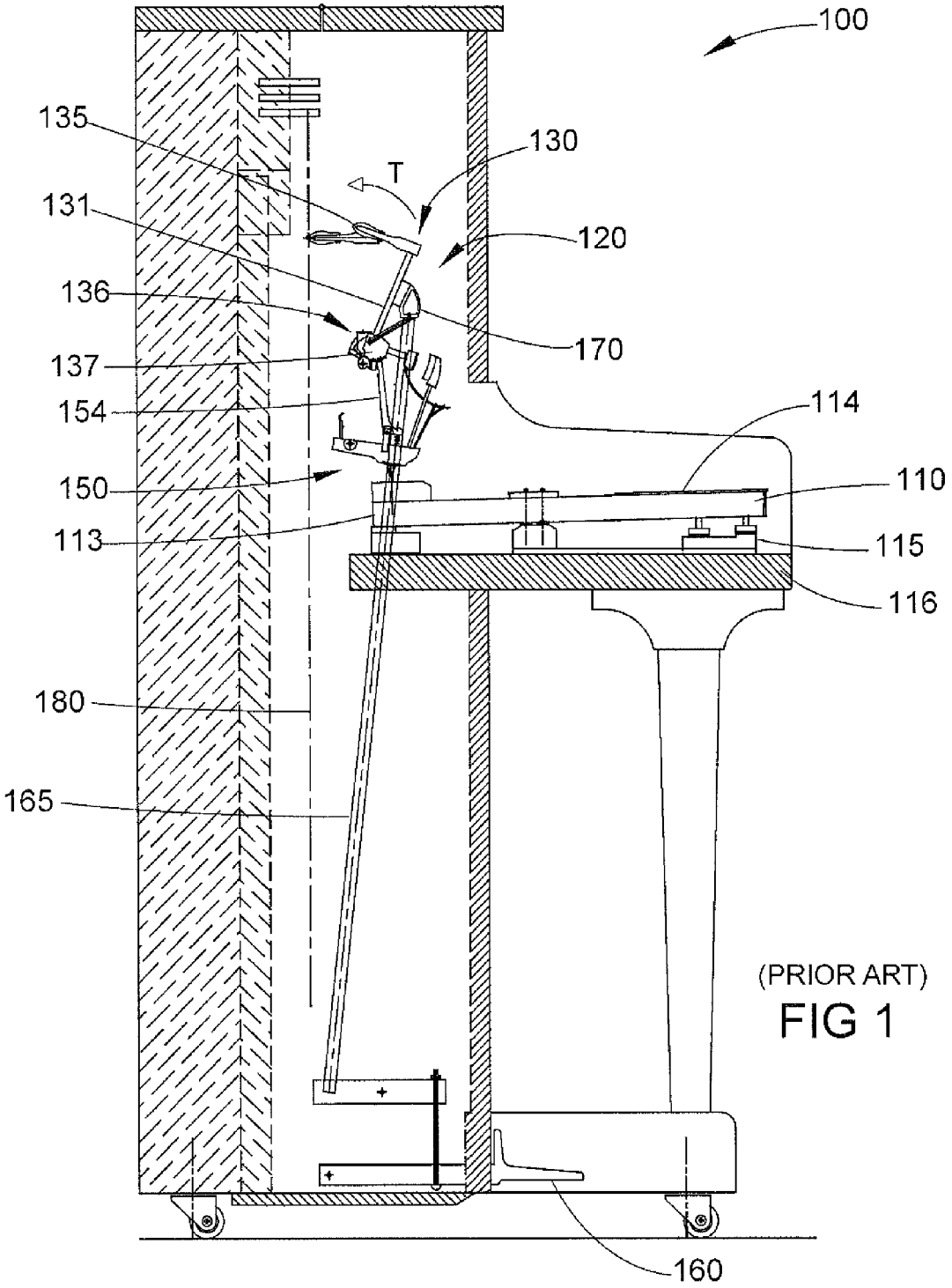
(PRIOR ART) FIG 1
FIG. 1 is a side section view of a conventional (prior art) upright piano with a soft pedal system.

Referring to FIG. 1, an upright or vertical piano 100 includes a series (or set) of piano keys 110 and corresponding piano actions 120 linked to rear segments 113 of the piano keys 110, which rest on a keyframe 115 attached to a keybed 116. Each piano action 120 is actuated by depressing the exposed playing surface 114 of a corresponding key 110. A series (or set) of (piano) hammer assemblies 130 includes rotatable piano hammers 135, each defining a forward throw direction, T, which are driven by corresponding wippen assemblies 150, and transmit forces applied upon the playing surfaces 114 of the corresponding keys 110. Each piano hammer 135 is aligned to strike a corresponding piano string or group of strings 180 upon being thrown. For example, the hammer 135 may strike between one and three strings 180 to produce the desired tone of the corresponding depressed key 110.

Figure 2:
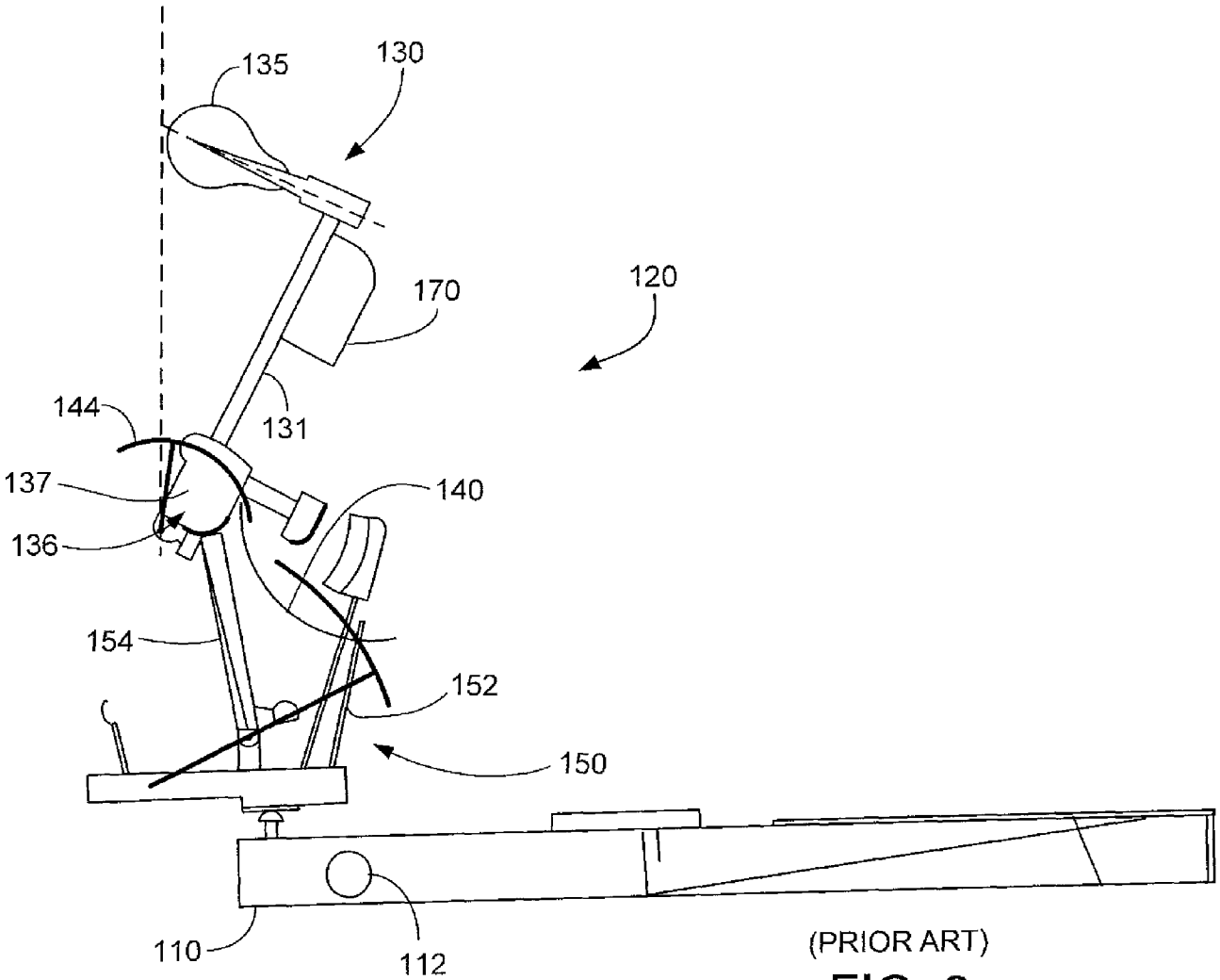
(PRIOR ART) FIG. 2
FIG. 2 is a side view of a piano action of conventional (prior art) design in an unplayed position.
Figure 3:
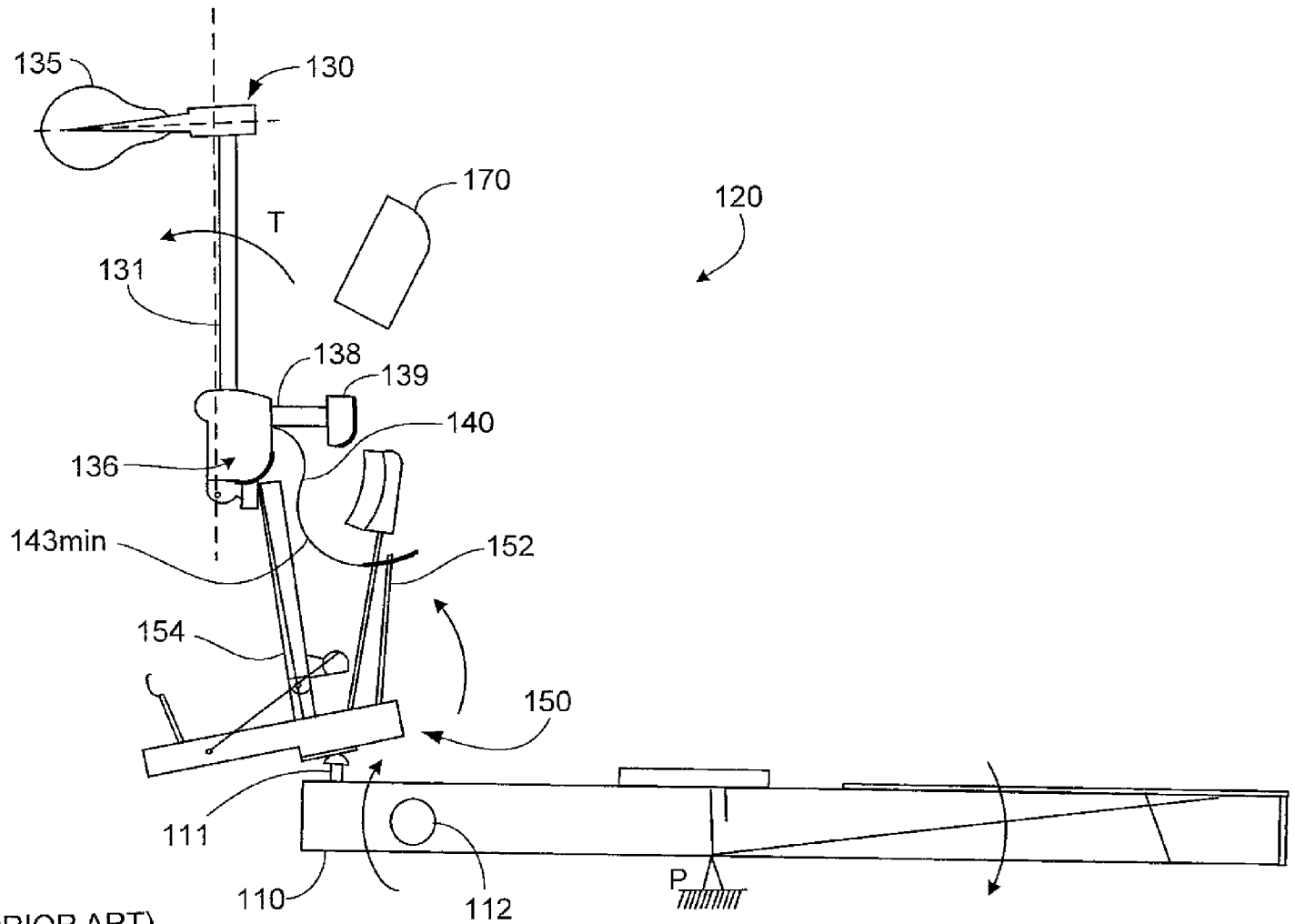
(PRIOR ART) FIG. 3
FIG. 3 is a side view of the conventional (prior art) piano action of FIG. 2 in a just-played position.

Referring to FIGS. 1 to 3, each hammer assembly 130 includes a hammer shank 131, a butt assembly 136 attached to a first end of the shank 131, and a hammer 135 attached to an opposite, second end of the shank 131. In the figures, the butt assembly 136 includes a butt 137, a dowel 138 and a catcher 139. Depressing or actuating piano key 110 causes a jack 154 of the associated wippen assembly 150 to push the butt assembly 136 of the hammer 135. When the jack 154 pushes the butt assembly 136, the butt assembly 136 and the hammer shank 131 are rotated in a forward throw direction, T, toward the piano string or strings 180 associated with the piano hammer 135. The piano hammer 135 strikes the piano string(s) 180, indirectly producing an acoustic sound. When the keys 110 are in a rest position, as shown in FIG. 2 (e.g., when a player is not pressing the keys 110), the hammers 135 remain in home positions, resting on a soft pedal or hammer resting rail 170 and/or the jack 154.

A thin, flexible tether, termed "bridle strap" 140, links the corresponding hammer and wippen assemblies 130, 150 and restricts these assemblies from rotating apart. In the conventional implementation, shown, e.g., in FIG. 2, one end of the bridle strap 140 is attached, e.g., permanently attached, to the hammer assembly 130 at the butt assembly 136. The other end of the bridle strap is pinned to a bridle wire 152 on the wippen assembly 150 in such a way that it can be disconnected from the bridle wire to permit service on the piano action 120. The bridle strap 140 also supports the wippen assembly 150 when the piano action 120 or piano key 110 is removed for servicing. During normal use, conventional bridle straps 140 remain slack and do not lift the wippen assemblies 150. The bridle straps 140 thus have no function during key depression, and only provide a tether function during key release or when the piano action 120 is removed from the piano.

Referring to FIG. 2, when the key 110 is unplayed, the bridle strap 140 is typically curved and slack as it joins the hammer and wippen assemblies 130, 150, and it has an indeterminate span (or distance between ends) 143. Upon key depression, as the key 110 pivots during play, the end of the bridle strap 140 attached to the bridle wire 152 follows the radius and direction of travel indicated by lower arc 142, while the end of the bridle strap 140 attached to the butt assembly 136 follows the radius and direction of travel indicated by the upper arc 144. Since the lower arc 142 has a radius that is relatively greater than the radius of the upper arc 144, the distance between the two terminations becomes smaller and the bridle strap 140 becomes relatively more relaxed (slack) to a minimum separation distance as the key is depressed, i.e., a bridle strap span $\mathbf{143}_{min}$ of the bridle strap 140 is smaller than the unplayed span 143.

The slack bridle strap 140 in its more highly relaxed, depressed-key configuration is shown in FIG. 3, which depicts the moment when key 110 has reached nearly full depression. The key 110 has been pivoted about its central pivot point (P), lifting the wippen assembly 150. This movement, in turn, has rotated the hammer assembly 130 toward the piano string 180 located to the left of the hammer assembly 130 (not shown). Due to the shortening of the span of the bridle strap 140, the flexible strap is now noticeably more relaxed, i.e., the bridle strap span 143 has decreased considerably from the initial span shown in FIG. 2.

Figures 4A, 4B:
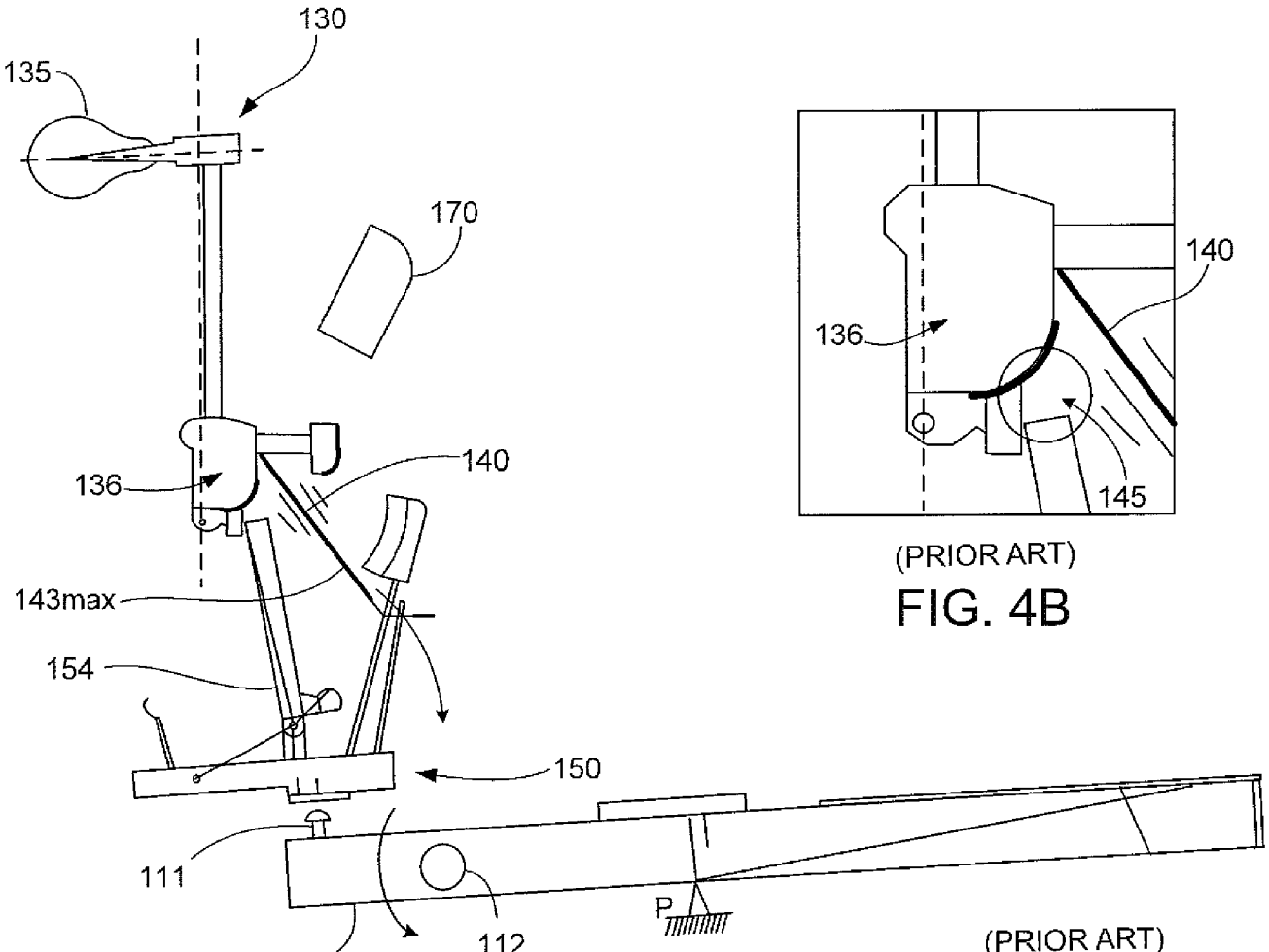
(PRIOR ART) FIG. 4B
(PRIOR ART) FIG. 4A

Up to this point during a keystroke, the bridle strap 140 has served no function in the piano action. It is only during key release that the bridle strap 140 becomes active, e.g., as shown in FIGS. 4A and 4B. Having played the note and caused the piano hammer 135 to strike the appropriate piano string(s) 180, the musician releases the key 110. Key weights 112 associated with, e.g., embedded in, the rear segment 113 of the key cause the key 110 to immediately pivot, returning to its initial, unplayed position. As the key 110 is no longer supporting the piano action 120, the wippen assembly 150 falls downward, while the hammer assembly 130 lags behind, in part due to its center of gravity being nearly vertical above its center of rotation. The falling wippen assembly 150 tensions the bridle strap 140 which is at or near its maximum span $\mathbf{143}_{max}$, pulling the hammer assembly 130 backward toward its rest position.

As shown most clearly in FIG. 4B, during this release of the piano key, a temporary gap 145 opens between the jack 154 of the wippen assembly 150 and the butt assembly 136 of the hammer assembly 130 due to the time lag between the return motions of the two assemblies (i.e., the wippen assembly 150 and the hammer assembly 130). The gap 145 causes an unwanted touch sensation, known as "lost motion", at the beginning of the next keystroke if the key is played again before the gap 145 closes. If a second keystroke is initiated at this point, i.e., during key release, a clear sense of lost motion can be detected as the new keystroke must cause the wippen assembly 150 to traverse the gap 145 before contacting the hammer assembly 130. This temporary change in the feel of the piano action is near universally considered to be a negative characteristic specific to upright or vertical pianos.

Lost motion also occurs when a soft pedal is depressed. Referring again to FIG. 1, when a soft pedal 160 of an upright or vertical piano 100 is depressed, an attached linkage or wire 165 actuates the hammer resting rail 170 to pivot all eighty-eight hammer assemblies 130 in a typical conventional (prior art) piano 100 upward and closer to the strings 180. This reduction in hammer travel distance creates a sense of lower, "softer" tonal volume in the piano 100.

Figures 5A, 5B:
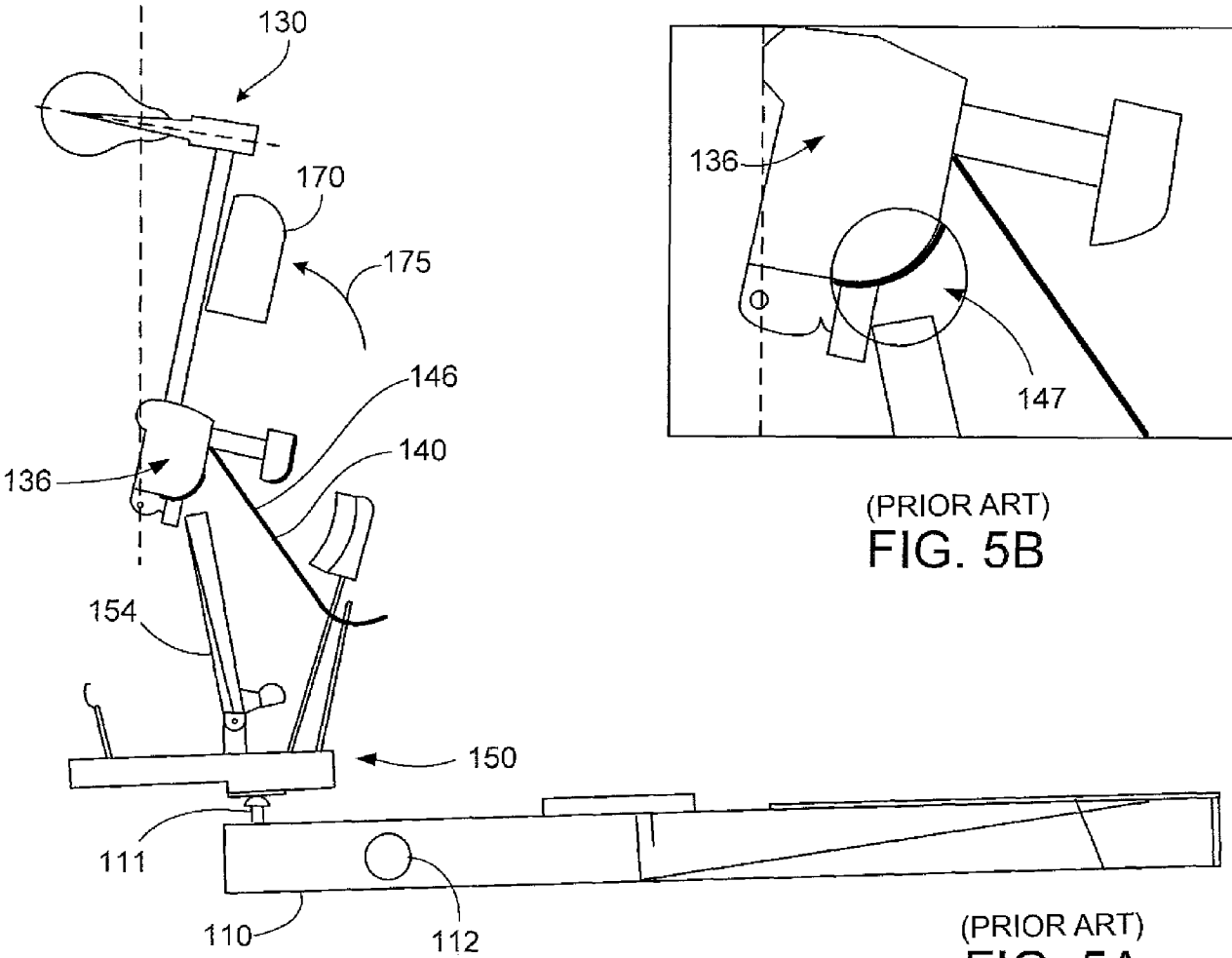
(PRIOR ART) FIG. 5B
(PRIOR ART) FIG. 5A

As shown in FIG. 5A, the motion of hammer resting rail 170 in the direction of resting rail motion (arrow 175) moves all of the hammer assemblies 130 upward and toward the piano strings 180. At full soft pedal 160 depression, the bridle strap 140 approaches a state of tension having a soft pedal span 146 (note its straightened attitude); however, the bridle strap 140 traditionally does not exert any lifting force on the lower wippen assembly 150. The soft pedal position of the hammer assemblies 130, in this lifted position, results in another occurrence of lost motion due to a gap 147 (FIG. 5B), produced between the jack 154 and the butt assembly 136. The gap 147, due to the rotation of the hammer assemblies 130, is produced uniformly across the keyboard of vertical piano 100 when the soft pedal 160 is depressed. When the soft pedal 160 is released, hammer assemblies 130 rotate back to their original positions, restoring their longer travel distance and eliminating the lost motion gap 147. As with the lost motion produced through rapidly repeated keystrokes in normal, non-soft pedal mode, the lost motion due to depression of soft pedal 160 has always been viewed as an undesirable but necessary compromise in the cost-limited upright or vertical piano action design.

Figure 6:
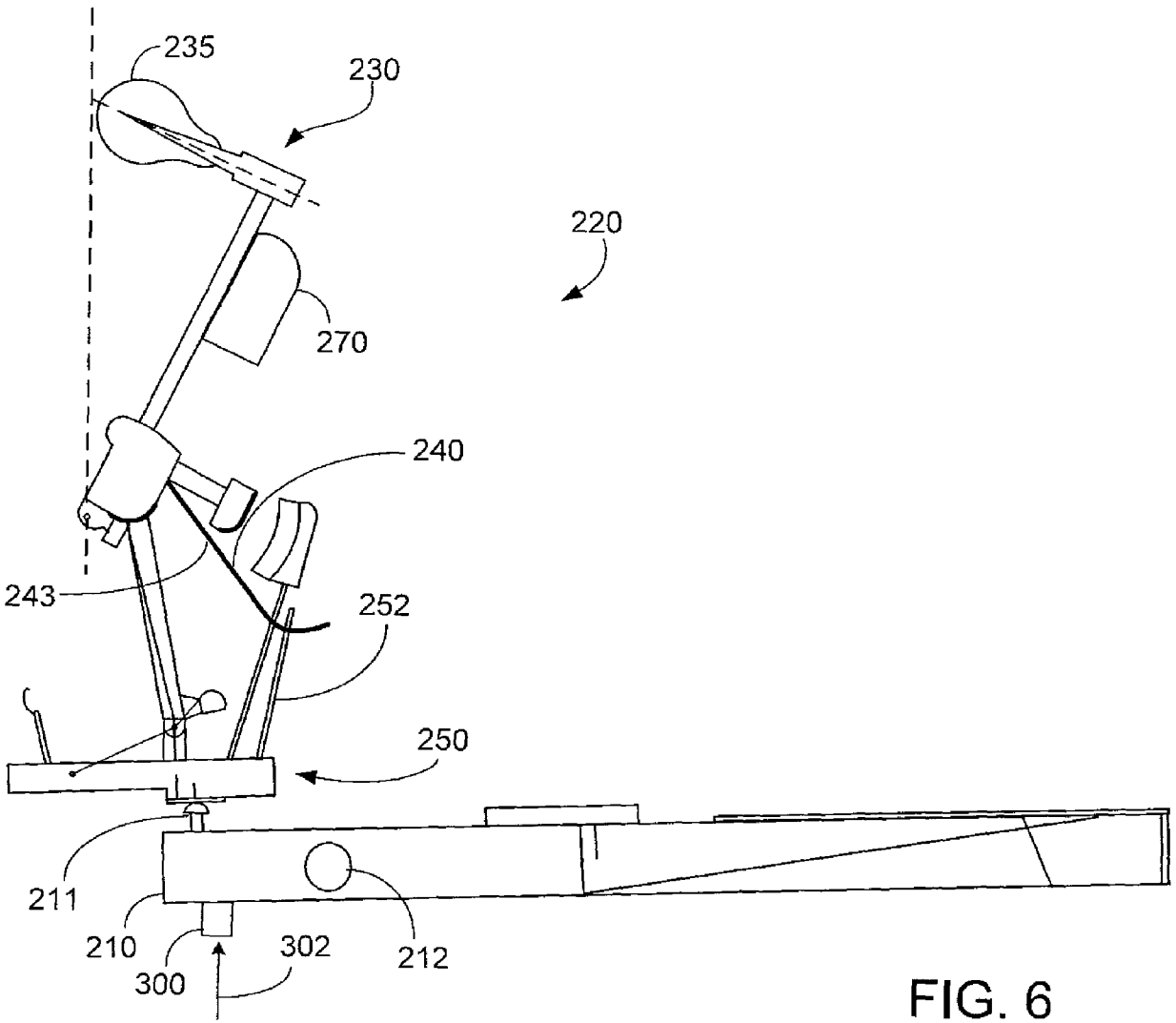
FIG. 6 is a side view of an extended soft pedal piano action of this disclosure in an unplayed position.

Referring to FIG. 6, the piano key action arrangement of the current disclosure reduces the unwanted feel of lost motion by closing, or even eliminating, the gaps 145 and 147 between the hammer and wippen assemblies 230, 250. As shown in FIG. 6, in a upright piano 200 of this disclosure, a piano action 220 includes a relatively more tensioned bridle strap 240 and bridle wire 252 combination, i.e., a piano action 220 in which one or both of bridle strap 240 and bridle wire 252 are tensioned, or at least relatively more tensioned, than in conventional (prior art) upright or vertical pianos. In particular, the respective lengths of the bridle wire 252 and bridle strap 240 are chosen to maintain tensioning of the bridle strap 240 across the span between attachment of its respective ends to the bridle wire 252 and to the hammer assembly 230, with the span of the tensioned bridle strap being approximately constant between initial position and final position, and also during transition between initial position and final position. This permits the bridle strap 240, with minimal or no slack in rest position, to maintain a relatively constant tension through key depression and release. The gap 145, resulting in prior art pianos largely from a slack bridal strap, is largely eliminated, thereby greatly reducing or eliminating lost motion between the piano hammer and piano wippen assemblies 230, 250 during rapidly repeated keystrokes in normal, non-soft pedal mode.

The relatively more tensioned bridle strap 240 and bridle wire 252 combination also produces a striking addition to the function of soft pedal 260, reducing the unwanted feel of lost motion by reducing or eliminating the gap 147 (FIG. 5B) between the hammer and wippen assemblies 230, 250 when the soft pedal is depressed. Since the bridle strap 240 is now at least close to tension in rest position (as shown in FIG. 6), during the raising of the hammers 235 with the soft pedal 260, the hammer and wippen assemblies 230, 250 remain in gap-closing proximity to, or in engagement with, each other at all times.

Figures 7A, 7B:
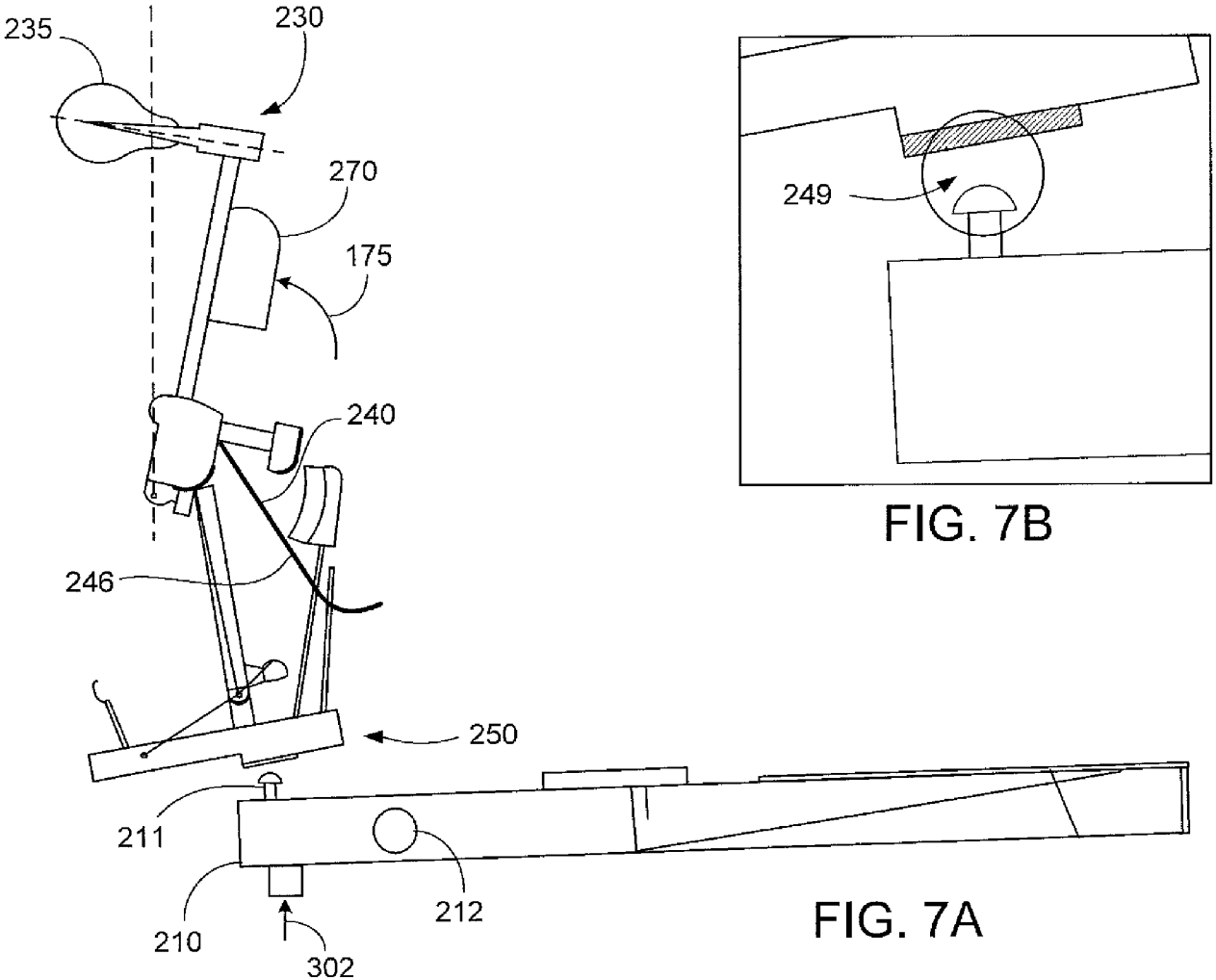

Referring as well to FIG. 7A, with the relatively more tensioned bridle strap 240 and bridle wire 252 combination, depressing the soft pedal 260 rotates the hammer resting rail 270 and hammer assemblies 230, as in the traditional design (e.g., in the direction of motion 275). Now, however, the relatively more tensioned bridle strap 240 and bridle wire 252 combination lifts the wippen assemblies 250 in tandem with the hammer assemblies 230, removing all the weight of the piano action 220 from the keys 210. The bridle strap 240 remains close to or in tension throughout motion of the piano action 220 (i.e., span 246 remains relatively unchanged during movement of the action 220). Additionally, the soft pedal bridle strap span 246 is relatively unchanged from the bridle strap span 243 in normal mode (see FIG. 6).

Vertical or upright pianos, e.g. such as piano 100, are typically weighted in their rear segments 113 in order to achieve a desired level of touch resistance in the keys (in contrast to grand piano keys, which are typically weighted in the front segments). In the embodiment of the upright piano 200 of this disclosure, as shown in FIG. 7A, the keys 210 have key weights 212 in the rear segment 213. As a result, the vertical piano keys do not apply upward force against the hammer and wippen assemblies 230, 250, and so the presence of any lost motion, due either to use of the soft pedal 260 or to the playing of rapid, repeated keystrokes, is not mitigated by the keys. In other implementations, the keys 210 may not include weights 212, and thus may be unweighted in either the front or rear segments of the keys.

Referring to FIGS. 7A and 7B, an undesirable gap 249, between capstans 211 and wippen assemblies 250, can also result in the unwanted feeling of lost motion when the soft pedal 260 is depressed. To compensate for the gap 249 in the piano action 220, a key lifting assembly including a lightly sprung lift rail 300 is positioned beneath the key rear segment 213. This lift rail 300 is mounted for movement in a direction of lift rail action (arrow 302) between a first position, preferably touching the bottom surface of, but not lifting, all 88 keys, and a second position, in which the lift rail 300 pivots (or otherwise moves) to lift the key rear segments 213, causing them to follow the motion of the wippen assemblies 230, thereby eliminating lost motion. Since the keys 210 pivot very easily, only a light spring force is applied by the lift rail 300 of the present disclosure, which therefore does not intrude on the touch characteristics of the piano action 220.

Figure 7C:
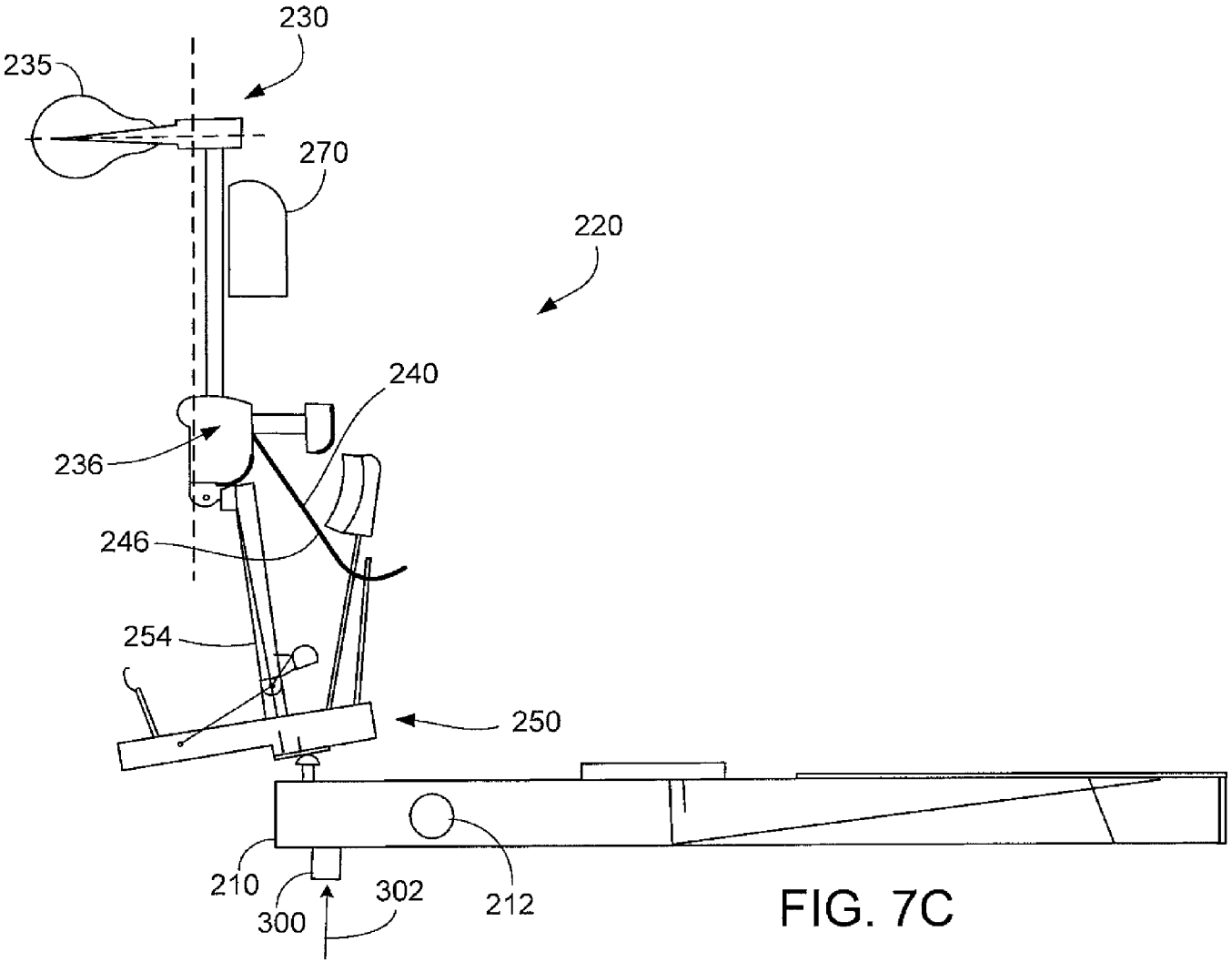
FIG. 7C is a side view of the soft pedal piano action of FIG. 6 with the lost motion-producing gaps closed.

Referring to FIG. 7C, the action 220 of the piano 200 of this disclosure is shown with the soft pedal 260 depressed and the lift rail 300 engaged. The lift rail 300 supports the keys 210 in a manner to maintain the keys at least in close proximity to, or in contact with, the wippen assembly 250. The combination of the lift rail 300 with the relatively tensioned bridle strap 240 and bridle wire 252 combination maintains contact between the keys 210 and the wippen assembly 250, and between the jack 254 and the butt assembly 236. During motion of the piano action 220, the span 246 of the bridle strap 240 and bridle wire combination remains generally constant, including at the start and end points of, and during, travel. This design results in significant reduction, or elimination, of the gaps 249 and 147 resulting in lost motion of the piano action 220 during playing of the piano.

Figure 8:
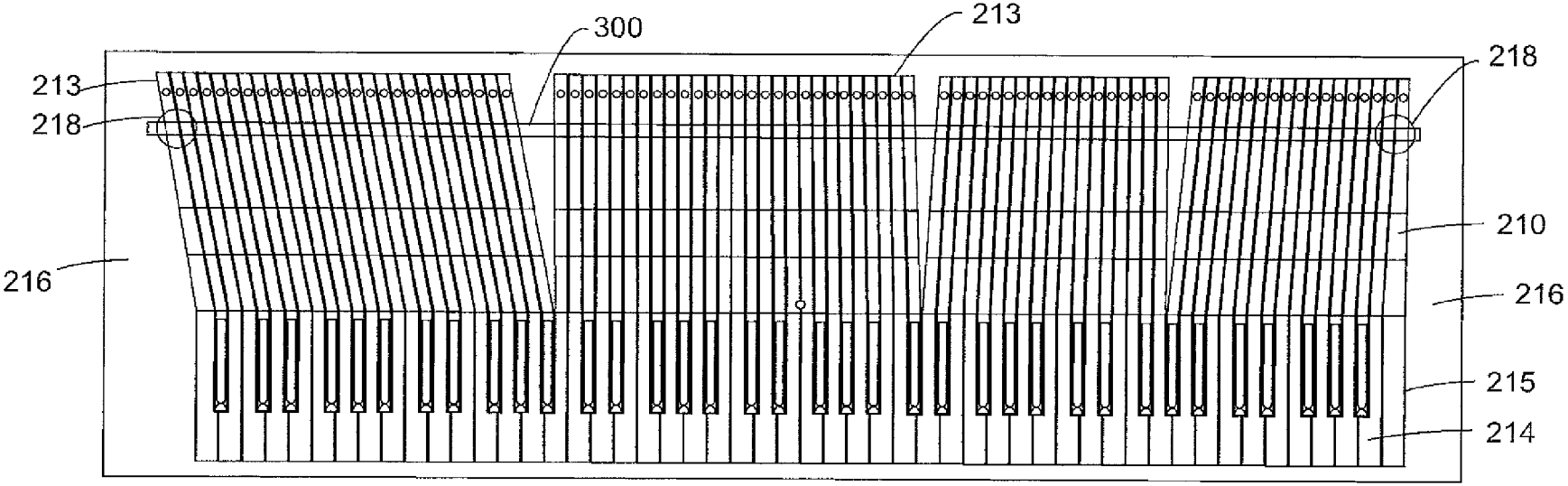
FIG. 8 is a top view of an upright piano including the extended soft pedal piano action of FIG. 6.

In FIG. 8, the key and keybed area of an upright piano 200 of this disclosure is shown in a top view, including keys 210, the closely tethered hammer and wippen assemblies 230, 250, and the playing surfaces 214 of the keys 210. The keys 210 rest on a supporting keyframe 215, which is supported by a keybed 216. The lift rail 300 (shown in cross section in FIG. 7A) spans the eighty-eight keys 210 of the upright piano, beneath the rear segments 213 of the keys 210.

Two or more lift rail spring assemblies 310, which are also part of the key lifting assembly, are located at various positions beneath the keys along the length of the keyboard to provide force sufficient to lift the keys 210. For example, the lift rail spring assemblies 310 can be located near the first key and the last keys, such as at position(s) 218. Alternatively, the lift rail spring assemblies 310 can be located at other positions along the keys, such as at one quarter and at three quarters along the length of the keyboard, or at one third and two thirds along the length of the keyboard. There can also be more than two lift rail spring assemblies 310 arranged at various positions along the keyboard.

Figure 9:
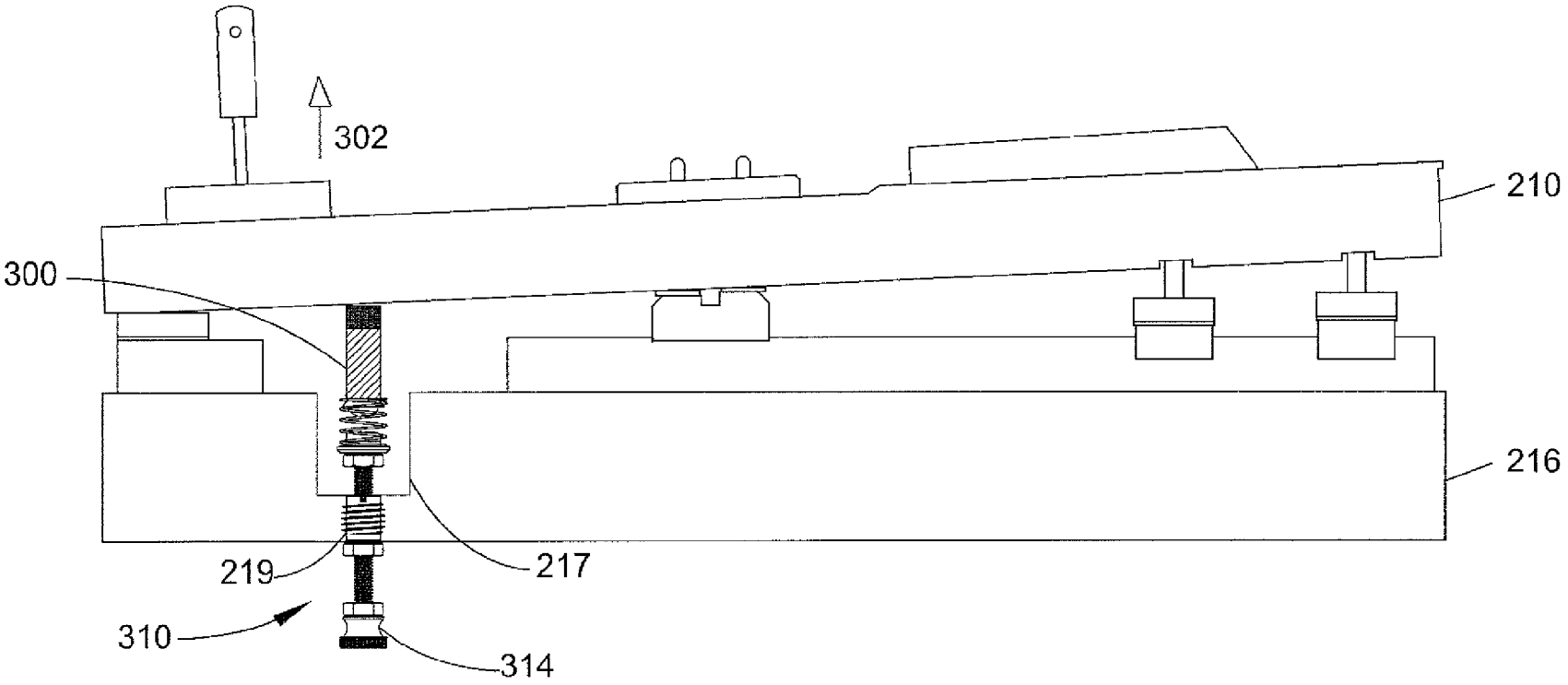
FIG. 9 is a side view, partially in section, of the extended soft pedal piano action of FIG. 6 including a lift rail spring assembly.

Referring to FIG. 9, in another implementation of the lift rail spring assembly of this disclosure, key 210 is shown in cross section above the rail spring assembly 310, in an unlifted position. The key 210 (and each of the keys 210) rests against the lift rail 300. Each lift rail spring assembly 310 is fastened (e.g., with screws countersunk into holes 217 provided in keybed 216) into position (e.g., position 218, as shown in FIG. 8). An adjustment member, e.g. a knob, 314 is provided for raising (and lowering) the set position of the lift rail 300, and therefore of the keys 210, upwards (and downwards), thereby increasing (and decreasing) the lift force applied by the rail spring assembly 310. Alternatively, adjustment member 314 can be, e.g., a thumb screw, an allen bolt adjustable by wrench, a screw adjustable by a screwdriver, or other suitable rotatable threaded or otherwise adjustable member.

Figure 10:
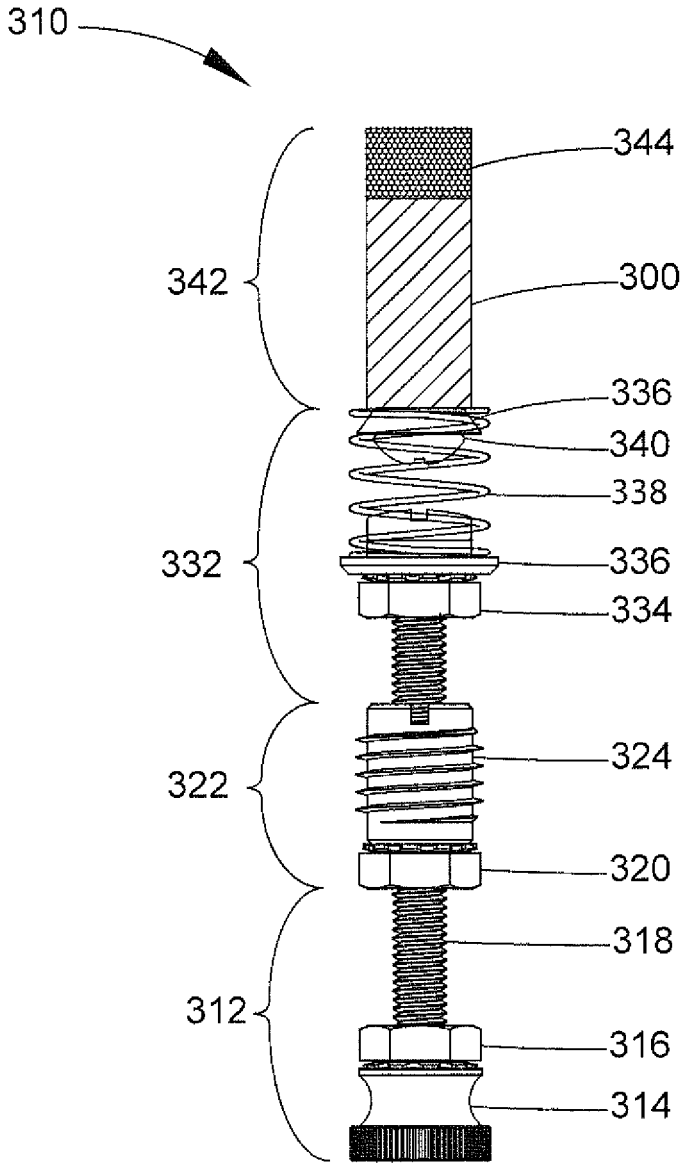
FIG. 10 is a detailed side view, partially in section, of the lift rail spring assembly of FIG. 9.

Referring to FIGS. 9 and 10, the lift rail spring assembly 310 consists of four portions: a knob portion 312, a keybed embedded portion 322, a keybed recess portion 332, and a lift rail portion 342. An assembly hole 219 at the base of the assembly countersink 217 of the keybed 216 fixedly receives a threaded insert 324. A machine screw 318 is threaded through the threaded insert 324 in the assembly hole 219, such that the machine screw 318 extends both below the keybed 216 and above, within the assembly countersink 217. A user, wishing to adjust the relative lifting force of the lift rail 300, loosens locknut 320, advances or retracts the adjustment knob 314 (secured by locknut 316) attached to a bottom end of the machine screw 318, and then re-tightens locknut 320. Advancing or retracting the machine screw 318 (i.e., relative to threaded insert 324 and locknut 320) changes the position of the machine screw 318 relative to the keybed 216. For example, advancing the machine screw 318 causes the machine screw 318 to move upwards, along with the components of the keybed recess portion 332 accommodated in the assembly countersink 217. The keybed recess portion 332 includes a compression spring 338 coaxially arranged about a screw 340 and resting at either end on a spring cap 336 (the spring cap 336 at the lower end being secured by locknut 334). The lift rail 300 rests against the upper spring cap 336, and supports the keys 210 above, which rest on a suitable cushioning material 344, such as a felt or foam piece at an upper surface of the lift rail 300.

The biasing properties of the spring 338 are chosen such that the spring 338 exerts a force sufficient to lift the combined weight of the lift rail 300 and the keys. The force exerted by the spring 338 causes the lift rail 300 to maintain contact with and push upwardly on the key 210, causing the key in turn to remain in close proximity to, or engagement with, the wippen assembly 250, and the hammer assembly 230.

The position of the lift rail 300 and/or the force exerted by the spring 338 may need to be adjusted by a user, either when the piano 200 is manufactured, or at some later point during the life of the piano.

To adjust the key lifting assembly, the key lifting assembly is positioned to be sitting on the keybed 216 (not supported by the springs 338), with the lift rail 300 out of engagement with the bottom surfaces of the keys 210. The user then presses and holds the soft pedal 260, thereby lifting the hammer resting rail 270 and the hammers 235. Since the bridle straps 240 are tensioned, the wippen assemblies 250 are lifted along with the hammers 235, and the lost motion-producing gaps 249 appear. To close the gaps 249 between the capstans 211 and wippen assemblies 250, the user continues to hold the soft pedal 260 while turning the adjustment knobs 314 that control the embedded portion 322 of the lift rail 300 supporting the compression springs 338. Turning the adjustment knobs 314 raises the embedded portion 322, which raises and compresses the springs 338, which raises the lift rail 300. As the lift rail 300 rises, it lifts the keys 210 and closes the gaps 249. While holding the soft pedal 260, the user continues to raise (by turning the knobs 314) the lift rail 300 until the gaps 249 under all 88 keys are closed. At this point, the lost motion gaps produced between the key capstans 211 and wippen assemblies 250 are gone.

Alternatively, to adjust the position of the lift rail 300 and/or the force exerted by the spring 338, a different protocol may be employed. In particular, from a position where the lift rail 300 is out of engagement with bottom surfaces of the keys 210, the user turns the adjustment knobs 314 located beneath the keybed to raise the spring rail assembly 310 upward (relative to the rail 300). When all the hammers 235 are observed being lifted off the lift rail 300, the user then turns the adjustment knobs 314 in the opposite direction until the affected hammers are no longer lifted. The lock nuts are then retightened to secure the adjustment.

A number of implementations of the disclosure have been described. Nevertheless, it will be understood that various modifications may be made without departing from the spirit and scope of the invention. For example, other devices for lifting the wippen assemblies 250 and the piano hammers 235 as a unit when the soft pedal 260 is depressed are also within the scope of this disclosure. For example, bridle straps 240 that are longer or shorter than is typical in the prior art and/or bridle wire 252 that are longer or shorter than typical in the prior art may be employed. The distribution of mass in the piano wippen assemblies 250 may also be rearranged or otherwise modified in a manner to urge or favor movement of the piano wippen assemblies acting under the force of gravity to rotate in the forward throw direction (arrow T, FIG. 3). Alternatively, or in addition, other means, e.g. mechanical, magnetic, or electromechanical linkages or the like, may be employed to impart upward lifting, downward pushing, or rotational forces in a manner to cause the piano wippen assemblies 250 to move with the piano hammers when the soft pedal is depressed.

Although a lift rail 300 has been described, mechanisms that lift (or rotate) the rear segments 213 of the piano keys upward or push (or rotate) the forward segments of the piano keys (in front of the pivot) downward while the key is unplayed are also within the scope of this disclosure. For example, this can include one or more downward-pushing elements engaging the forward segment of keys 210, producing rotational motion about the pivot point P (shown in FIG. 3), e.g. by engagement with upper surfaces of the keys, or by application of attractive or forces to the forward or the rear segments of the keys, e.g., produced by light-weight magnets embedded in the keys, or electromagnetically attractive materials embedded in the keys for interaction with one or more magnetic elements in the keyframe 215 or keybed 216. Distribution of mass in the piano keys 210 may also be rearranged or otherwise modified, e.g. to shift the weight balance toward the front segments of the piano keys.

Figure 11:
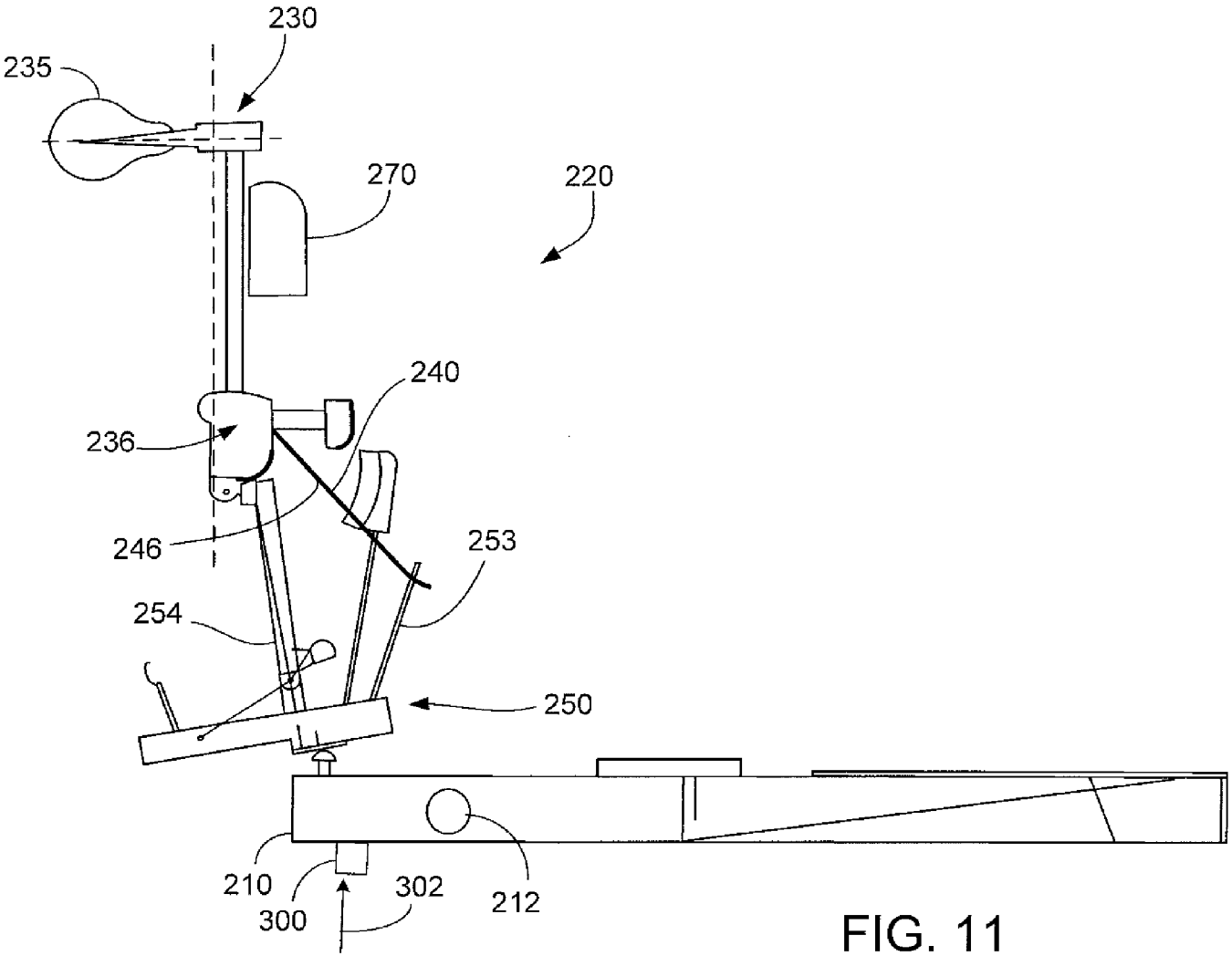
FIG. 11 is a detailed side view of an embodiment of the soft pedal piano action of FIG. 7C.
Figure 12A:
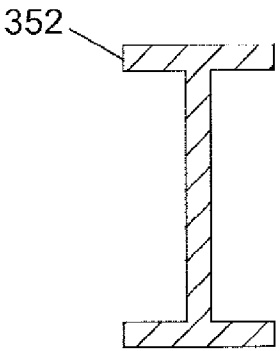
FIGS. 12A through 12J show alternative section views for the spring rail of the extended soft pedal piano action of FIG. 6.
Figure 12B:
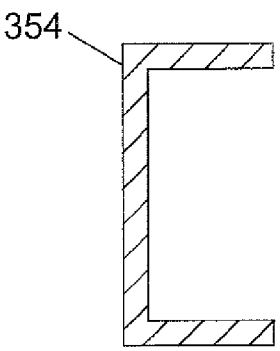
Figure 12C:
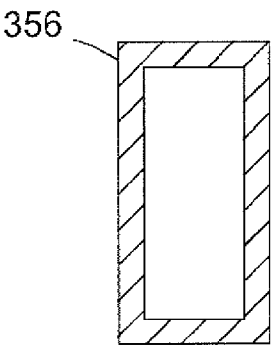
Figure 12D:
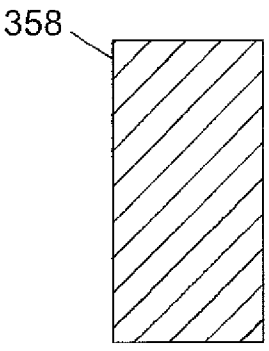
Figure 12I:
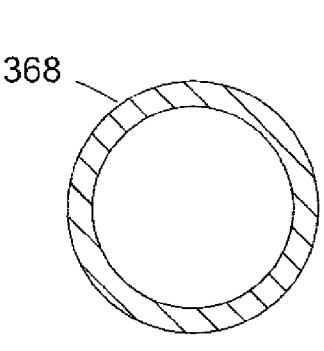
Figure 12E:
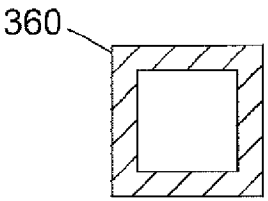
Figure 12F:
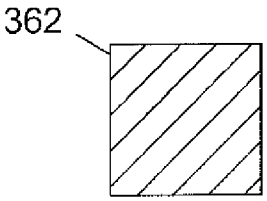
Figure 12G:
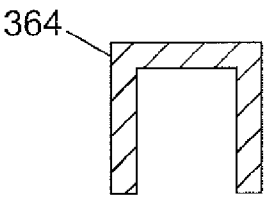
Figure 12H:
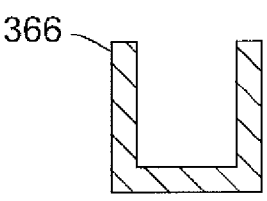
Figure 12J:
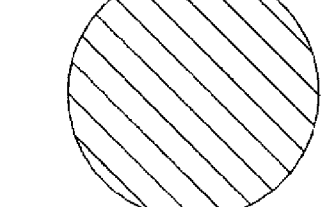

In another implementation, shown in FIG. 11, lost motion may be reduced by adjustment of positioning of the upper end portion of the bridle wire 253 to which the associated end of the bridle strap 240 is pinned, e.g. by bending the body or a portion of the body of the bridle wire 253 (typically towards the player), and/or by adjusting, e.g. lengthening or shortening, the body of the bridle wire 253.

The force exerted by the tensioned bridle strap 240 and bridle wire 252, in combination with the biasing force exerted by spring 338 when the piano is used in soft mode, can reduce or eliminate lost motion induced by separation of the elements of the piano key action. The soft pedal design of the present disclosure thus improves the normal mode of performance in the upright or vertical piano action by improving its touch characteristics to more closely resemble those of a grand piano.

In some implementations, combining one or more of the above-described techniques and devices can result in an upright piano with improved lost-motion characteristics. For example, in the implementation of FIG. 11, the bent bridle wire 253 with a relatively shortened bridle wire 252 and shortened bridle strap 240, and the lift rail 300 are all shown employed in the piano 200. However, it is recognized the variations of the span of the bridle strap 240 can result in differing reductions (improvements) in control of lost motion. For example, changes in the lengths of the bridle strap 240 and bridle wire 252, and the bend of the bridle wire 253 (in combination with the lift rail 300) can be optimized such that gaps are reduced to, or nearly to, 0 mm during both normal and soft pedal modes of play, resulting in a 100% reduction in lost motion sensation. In other implementations, the gap may be reduced to less than 3 mm, e.g., to less than 2 mm, or to less than or equal to 1 mm.

In the example shown in FIG. 7C, only the relatively shortened bridle wire 252, relatively shortened bridle strap 240, and lift rail 300 are employed.

In a still further implementation, use of only a bent bridle wire 253 may reduce lost motion in normal mode by up to 60 or 70%, and use of a bent bridle wire 253 and a lift rail 300 may reduce lost motion 60-70% in normal mode and in soft pedal mode.

In other implementations, the lift rail 300 may have suitable cross sections other than a rectangular bar. For example, as shown in FIGS. 12A through 12J, respectively, lift rail 300 may have a section configured as an I-beam 352, a C-channel 354, a rectangular tube 356, a rectangular bar 358, a square tube 360, a square bar 362, an N-channel 364, a U-Channel 366, a round tube 368, round bar 370, or any other suitable configuration. The lift rail 300 may be formed of metal, plastic, wood, or other suitable material.

Accordingly, other implementations are within the scope of the following claims.

What is claimed is:

1. A piano selectably playable in a normal mode and in a soft mode comprises:

a set of multiple piano keys;

a set of multiple piano actions associated with said multiple piano keys, each said piano action comprising a piano hammer assembly and a piano wippen assembly actuated by depression of a corresponding said piano key;

a set of multiple piano hammers, each said piano hammer mounted for rotating movement and defining a forward throw direction toward at least one corresponding piano string, each said piano hammer being driven by a corresponding said piano wippen assembly to transmit force applied to an associated said piano key;

a set of multiple bridle straps, each said bridle strap connecting a said piano hammer to a corresponding said piano wippen assembly; and a key lifting assembly in engagement with said piano keys, wherein said key lifting assembly and an associated said bridle strap under tension cooperatively bring corresponding said piano keys and said piano wippen assemblies together in gap-closing movement.

2. The piano of claim 1, wherein said key lifting assembly and an associated said bridle strap under tension cooperatively lift said piano wippen assemblies and rear portions of said piano keys.

3. The piano of claim 1, wherein said key lifting assembly and an associated said bridle strap under tension cooperatively lift rear portions of said piano keys.

4. The piano of claim 1, wherein said key lifting assembly and an associated said bridle strap under tension cooperatively lift said piano wippen assemblies.

5. The piano of claim 1, wherein said piano actions comprise:

a set of multiple piano wippen assemblies, with each said piano wippen assembly disposed for engagement with a portion of a corresponding said piano hammer when said piano hammer is in a rest position, and the corresponding said bridle strap tethering said piano hammer to said piano wippen assembly, wherein said key lifting assembly and associated said bridle strap under tension cooperatively bring said piano wippen assembly and said piano hammer together in gap-closing movement during depression and subsequent release of said piano key.

6. The piano of claim 5, wherein said key lifting assembly and associated said bridle strap under tension cooperatively bring said piano wippen assembly and said piano hammer together into gap-closing engagement during depression and subsequent release of said piano key.

7. The piano of claim 1, comprising a soft pedal system, the soft pedal system comprising:

a soft pedal;

a hammer resting rail mounted for movement between a normal mode position with said set of multiple piano hammers at a spaced distance from corresponding said piano strings, and a soft mode position with the set of multiple piano hammers in positions relatively closer to the corresponding said piano strings; and a soft pedal actuation device, wherein actuation of the soft pedal causes movement of the hammer resting rail from normal mode position to the soft mode position.

8. The piano of claim 7, wherein the soft pedal actuation device comprises a link connecting the hammer resting rail with the soft pedal.

9. The piano of claim 7, wherein when the hammer resting rail is in soft mode position, forces exerted by the bridle strap under tension and the key lifting assembly lift said piano wippen assembly and said piano keys.

10. The piano of claim 7, wherein when the hammer resting rail is in soft mode position, forces exerted by the bridle strap under tension and the key lifting assembly bring said piano wippen assembly relatively together in gap-closing motion with the corresponding said piano hammer.

11. The piano of claim 7, wherein when the hammer resting rail is in soft mode position, forces exerted by the key lifting assembly act to maintain said piano wippen assembly in gap-closing relationship with the corresponding said piano key.

12. The piano of claim 1, wherein the key lifting assembly comprises a lift rail disposed for engagement with at least a subset of said set of multiple piano keys.

13. The piano of claim 12, wherein the key lifting assembly comprises at least one biasing element urging the lift rail toward engagement with the piano keys.

14. The piano of claim 12, wherein the key lifting assembly comprises an adjustment member mounted to permit variation of lift rail position and lifting force.

15. The piano of claim 1, wherein said piano keys are additionally weighted.

16. The piano of claim 1, wherein said piano keys are not additionally weighted.

17. The piano of claim 1, wherein said piano comprises multiple said key lifting assemblies, each of said multiple said key lifting assemblies disposed for engagement with a subset of less than all of said multiple piano keys.

18. A piano playable in a normal mode and in a soft mode comprises:

a set of multiple piano keys;

a set of multiple piano actions, each said piano action actuated by depression of a corresponding said piano key;

a set of multiple rotatable piano hammers, each said rotatable piano hammer defining a forward throw direction toward at least one corresponding piano string, and each said rotatable piano hammer being driven by a corresponding said piano wippen assembly transmitting force from a corresponding said piano key; and a set of multiple bridle straps, each connecting a said rotatable piano hammer with a corresponding said piano wippen assembly, with the bridle strap remaining under gap-closing tension during the release of the corresponding said piano key.

19. A piano playable in a normal mode and a soft mode, the piano comprising:

a set of multiple piano keys;

a set of multiple piano actions, each said piano action actuated by depression of a corresponding said piano key;

a set of multiple rotatable piano hammers, each said rotatable piano hammer defining a forward throw direction toward at least one corresponding piano string, and each said rotatable piano hammer being driven by a corresponding piano wippen assembly to transmit force from a corresponding said piano key; and a key lifting assembly disposed beneath said set of multiple piano keys, wherein said key lifting assembly exerts a force biasing said set of multiple piano keys in the direction of piano key pivot consistent with piano key depression.

20. A piano playable in a normal mode and in a soft mode comprises:

a set of multiple piano keys;

a set of multiple piano actions, each said piano action actuated by depression of a corresponding said piano key;

a set of multiple rotatable piano hammers, each said rotatable piano hammer defining a forward throw direction toward at least one corresponding piano string, and each said rotatable piano hammer being driven by a corresponding piano wippen assembly, transmitting force from a corresponding said piano key; and a set of multiple bridle straps, each said bridle strap connecting a said rotatable piano hammer assembly with a corresponding said piano wippen assembly, wherein the bridle strap remains under tension during the release of the corresponding said piano key, each said bridle strap having a first end attached to a butt assembly of an associated piano hammer assembly and an opposite second end attached to an associated bridle wire, the bridle strap having an initial span between the first end of the bridle strap and the second end of the bridle strap when said piano key is in an unplayed position, and a final span between the first end of the bridle strap and the second end of the bridle strap when said piano key is in a played position, and the final span and the initial span of the bridle strap having a predetermined ratio under tension.

21. The piano of claim 20, wherein the predetermined ratio of the final span and the initial span is approximately 1.0.

22. The piano of claim 20, wherein the predetermined ratio of the final span and the initial span is greater than 1.

23. A piano selectably playable in a normal mode and in a soft mode comprises:

a set of multiple piano keys;

a set of multiple piano actions associated with said multiple piano keys, each said piano action including a piano hammer assembly and a piano wippen assembly actuated by depression of a corresponding said piano key;

a set of multiple piano hammers, each said piano hammer mounted for rotating movement and defining a forward throw direction toward at least one corresponding piano string, each said piano hammer being driven by a corresponding said piano wippen assembly to transfer force applied to an associated said piano key;

a set of multiple bridle straps, each said bridle strap connecting a said piano hammer with a corresponding said piano wippen assembly;

a soft pedal system, the soft pedal system comprising:

a soft pedal;

a hammer resting rail mounted for movement between a normal mode position with said set of multiple piano hammers at a spaced distance from corresponding piano strings, and a soft mode position with the set of multiple piano hammers in positions relatively closer to the corresponding said piano strings; and a soft pedal actuation device, wherein actuation of the soft pedal causes movement of the hammer resting rail from the normal mode position toward the soft mode position; and a gap closing mechanism in engagement with said piano keys, wherein said gap closing mechanism lifts said piano keys and said piano wippen assemblies upon actuation of the soft pedal.

24. The piano of claim 23, wherein the bridle straps have a maximum span selected to bring said piano wippen assemblies and said piano hammers together in gap-closing movement.

25. The piano of claim 23, wherein said bridle strap has a first end fastened at a butt assembly of an associated said piano hammer assembly and an opposite second end fastened at an associated said bridle wire, and the bridle wire is configured to maintain the bridle strap at a maximum span during the force transfer applied to an associated said piano wippen assembly.

26. The piano of claim 23, wherein said gap closing mechanism rotates said piano wippen assemblies in the forward direction relative to the piano strings.

27. The piano of claim 26, wherein said gap closing mechanism comprises distribution of mass in said piano wippen assemblies in a manner to urge rotation of said piano wippen assemblies toward said piano strings.

28. A piano selectably playable in a normal mode and in a soft mode comprises:

a set of multiple piano keys;

a set of multiple piano actions associated with said multiple piano keys, each said piano action including a piano hammer assembly and a piano wippen assembly actuated by depression of a corresponding said piano key;

a set of multiple piano hammers, each said piano hammer mounted for rotating movement and defining a forward throw direction toward at least one corresponding piano string, each said piano hammer being driven by a corresponding said piano wippen assembly to transmit force applied to an associated said piano key;

a set of multiple bridle straps, each said bridle strap connecting a said piano hammer with a corresponding said piano wippen assembly;

a gap closing mechanism in engagement with said piano keys, wherein said gap closing mechanism lifts a rear portion of said piano keys to raise said piano wippen assemblies toward said piano hammers together in gap-closing movement.

29. The piano of claim 28, wherein the gap closing mechanism acts on the piano keys by lowering a front portion of the piano keys.

30. A piano selectably playable in a normal mode and in a soft mode comprises:

a set of multiple piano keys;

a set of multiple piano actions associated with said multiple piano keys, each said piano action including a piano wippen assembly actuated by depression of a corresponding said piano key;

a set of multiple piano hammers, each said piano hammer mounted for rotating movement and defining a forward throw direction toward at least one corresponding piano string, each said piano hammer being driven by a corresponding said piano wippen assembly to transfer force applied to an associated said piano key;

a soft pedal system, the soft pedal system comprising:

a soft pedal;

a hammer resting rail mounted for movement between a normal mode position with said set of multiple piano hammers at a spaced distance from corresponding piano strings, and a soft mode position with the set of multiple piano hammers lifted into positions relatively closer to the corresponding said piano strings; and a soft pedal actuation device, wherein actuation of the soft pedal causes movement of the hammer resting rail from the normal mode position toward the soft mode position and lifts said piano wippen assemblies along with said piano hammers in gap closing motion; and wherein, in normal mode position and in soft mode position, a standard key lever ratio of a piano key of:

distance between a central pivot point of the piano key and engagement of its capstan with an associated piano wippen assembly over distance between a top front edge of the piano key and the central pivot point is the same.

31. The piano of claim 30, further comprising a set of multiple bridle strap and bridle wire combinations, each said bridle strap and bridle wire combination connecting a said piano hammer assembly to a corresponding said piano wippen assembly, wherein actuation of the soft pedal actuation device tensions each said bridle strap and bridle wire combination to lift a said piano wippen assembly along with an associated said piano hammer assembly in the gap closing motion.

32. The piano of claim 1 or claim 31, wherein tensioning of at least one of the bridle strap and bridle wire combinations is achieved by shortening at least one of the bridle strap and the bridle wire.

33. The piano of claim 32, wherein the other of the bridle strap and bridal wire is additionally shortened.

34. The piano of claim 32, wherein the other of the bridle strap and bridal wire is additionally lengthened.

35. The piano of claim 1 or claim 31, wherein tensioning of at least one of the bridle strap and bridle wire combinations is achieved by lengthening at least one of the bridle strap and the bridle wire.

36. The piano of claim 35, wherein the other of the bridle strap and bridal wire is additionally lengthened.

37. The piano of claim 35, wherein the other of the bridle strap and bridal wire is additionally shortened.

38. The piano of claim 1 or claim 31, wherein tensioning of at least one of the bridle strap and bridle wire combinations is achieved by bending an upper end of the bridle wire below the bridle strap.

39. The piano of claim 38, wherein tensioning of at least one of the bridle strap and bridle wire combinations is achieved by bending the upper end of the bridle wire relatively farther from the piano wippen assembly and closer to a piano player.

40. The piano of claim 35, wherein tensioning of at least one of the bridle strap and bridle wire combinations is achieved by bending an upper end of the bridle wire below attachment of the bridle strap.

41. The piano of claim 35, wherein tensioning of at least one of the bridle strap and bridle wire combinations is achieved by repositioning the bridle wire.

42. The piano of claim 30, wherein the hammer resting rail actuation device in soft play mode engages and lifts a rear undersurface region of the piano keys.

43. The piano of claim 30, wherein the hammer resting rail actuation device in soft play mode engages and depresses a front upper surface region of the piano keys.

44. The piano of claim 42 or claim 43, wherein the hammer resting rail actuation device in soft play mode engages the piano keys with linear or rotational motion.

45. The piano of claim 42 or claim 43, wherein the hammer resting rail actuation device engages the piano keys by spring, magnetic, or electromechanical force.

* * * * *

UNITED STATES PATENT AND TRADEMARK OFFICE

CERTIFICATE OF CORRECTION

PATENT NO. : 8,927,835 B1
APPLICATION NO. : 14/045088
DATED : January 6, 2015
INVENTOR(S) : Marvin Scott Jones, Susan Yake Kenagy and Sue Guan Lim It is certified that error appears in the above-identified patent and that said Letters Patent is hereby corrected as shown below:

In the Claims

Col. 15, line 8, Claim 22, delete "1." and insert -- 1.0. --, therefor.

Signed and Sealed this
Twenty-first Day of April, 2015

Michelle K. Lee

Michelle K. Lee
*Director of the United States Patent and Trademark Office*